US007452462B2

(12) United States Patent
Joliet

(10) Patent No.: US 7,452,462 B2
(45) Date of Patent: Nov. 18, 2008

(54) VESSEL DESIGNED TO COLLECT WASTE ON BOARD

(75) Inventor: Jean-Pierre Joliet, Paris (FR)

(73) Assignee: Ecoceane SAS, Paris (FR)

( * ) Notice: Subject to any disclaimer, the term of this patent is extended or adjusted under 35 U.S.C. 154(b) by 0 days.

(21) Appl. No.: 10/520,944

(22) PCT Filed: Jul. 9, 2003

(86) PCT No.: PCT/FR03/02132

§ 371 (c)(1),
(2), (4) Date: Oct. 24, 2005

(87) PCT Pub. No.: WO2004/007273

PCT Pub. Date: Jan. 22, 2004

(65) Prior Publication Data

US 2006/0144774 A1 Jul. 6, 2006

(30) Foreign Application Priority Data

Jul. 12, 2002 (FR) ..... 02 09002

(51) Int. Cl.
*E02B 15/04* (2006.01)

(52) U.S. Cl. ..... 210/170.05; 210/242.3; 210/923

(58) Field of Classification Search ..... 210/170.05, 210/242.1, 242.3, 776, 923, 175
See application file for complete search history.

(56) References Cited

U.S. PATENT DOCUMENTS 3,708,070 A * 1/1973 Bell ..... 210/242.3
3,737,040 A * 6/1973 Brydoy et al. ..... 210/242.3
3,823,828 A * 7/1974 Derzhavets et al. ..... 210/242.3
3,966,615 A * 6/1976 Petchul et al. ..... 210/242.1
4,033,876 A * 7/1977 Cocjin et al. ..... 210/242.3
4,372,854 A 2/1983 Szereday
4,545,315 A 10/1985 Becherer
4,554,070 A * 11/1985 Jordan ..... 210/242.3
4,595,510 A 6/1986 Winbladh et al.
4,851,133 A * 7/1989 Rymal ..... 210/776
4,921,605 A * 5/1990 Chastan-Bagnis et al. ..... 210/242.3
4,963,272 A * 10/1990 Garrett ..... 210/923
5,019,277 A * 5/1991 Andelin ..... 210/776
5,173,182 A * 12/1992 Debellian ..... 210/242.3
6,022,476 A 2/2000 Hausin et al.

FOREIGN PATENT DOCUMENTS

| | | |
|---|---|---|
| FR | 2791947 | 10/2000 |
| GB | 2365387 | 2/2002 |
| WO | 00/27694 | 5/2000 |

* cited by examiner

*Primary Examiner*—Christopher Upton
(74) *Attorney, Agent, or Firm*—Lowe Hauptman Ham & Berner LLP

(57) ABSTRACT

A vessel travels over a surface of a body of water or a waterway to collect waste on and/or close to the surface. A retainer that traps and retains the waste is activated by creating a water flow channel that is connected to a water inlet and a water outlet on the vessel. The retainer is on at least one trajectory of said channel. Waste is collected without using a specific pumping or gathering device.

17 Claims, 3 Drawing Sheets

VESSEL DESIGNED TO COLLECT WASTE ON BOARD

RELATED APPLICATIONS

The present application is based on, and claims priority from, FR Application No. 02/09002, filed Jul. 12, 2002, and PCT Application No. PCT/FR03/002132 filed Jul. 9, 2003, the disclosure of which are hereby incorporated by reference herein their entireties.

FIELD OF INVENTION

The present invention relates to a vessel designed to travel over a surface of a body of water or a waterway, and to collect on board waste that is present close to and/or on said surface.

BACKGROUND ART

Such vessels are commonly used to rid port waters of waste floating on the surface thereof, such as floating objects or oil slicks.

Most vessels of this type make use of pumping devices which require relatively complicated mechanical, hydraulic and electrical installations and are thus expensive to produce and keep in operation. Moreover, an operator who has the task of checking that such devices are functioning will require good knowledge of mechanics, hydraulics and electricity, and this can only be provided by expensive training.

One of the objects of the invention is to provide a new and improved waste collecting vessel.

Another object is to provide a new and improved vessel for collecting waste without using a specific pumping or gathering device.

A further object is to provide a new and improved waste collecting vessel that does not require additional actions over and above those required to maneuver the vessel.

To this end, according to the invention, a vessel as mentioned in the introductory paragraph comprises a retainer able to trap and retain said waste, and to be activated by creating a water flow channel which is adapted to be connected to a water inlet and a water outlet provided in said vessel, the retainer being arranged on at least one trajectory of the channel.

The invention thus ensures automatic activation of the retainer simply by creating a flow of water along the water flow channel which then directs the various waste present at the water inlet of said channel towards the retainer, the water outlet returning water that has been 'filtered" since it has been freed of said waste.

The retainer could for example be activated solely by moving the vessel, and would thus not require any particular mechanism or control during operation thereof. All that is required is for an operator to pilot the vessel and to direct it towards the waste that he wishes to collect, with the vessel picking up said waste as it moves along. The only skill required by the operator in order to carry out such clean-up operations is the ability to maneuver such a vessel under its conditions of use, that is to say in a port, on a river, etc.

Preferably, the retainer includes a retainer for liquid waste located on a first trajectory of said channel.

The liquid waste retainer makes it possible, for example, to collect oil slicks which are present close to and/or on the surface of the body of water or waterway on which the vessel is traveling.

With a view to such an application, the vessel preferably also comprises a heater for an upper surface of the water flow channel. The heater is arranged to fluidify the oil which may be present in the form of clumps or semi-rigid pellets.

The liquid waste retainer, in one embodiment, comprises a holding tank arranged so the water flow through the flow channel is while the vessel is moving.

The vessel also preferably comprises a temperature regulator inside the holding tank. The temperature regulator enables the oil contained in the tank to stay in a liquid state to facilitate subsequent emptying of the tank, for example, by pumping.

The holding tank has various configurations. It preferably has:

- an inlet, adapted to be connected to the inlet of the water flow channel, formed by an upper edge of said tank and designed to be placed close to the surface of the water, and
- an outlet, adapted to be connected to the Outlet of said channel, formed by an orfice in a bottom of said tank and arranged to be obstructed by a closure in response to said tank being full of liquid waste.

Since oil is, by its nature lighter than water, oil gradually accumulates in the holding tank described above. As a result, the water, freed of this oil, escapes via the bottom of said tank. The tank thus makes it possible to collect and store liquid waste without in any way interrupting the flow of water along the flow channel between the water inlet and the water outlet. This flow is interrupted only in response to the holding tank being full, that is to say, when the vessel cannot collect any more liquid waste on board. Such an interruption to the flow is then brought about by the closure.

The closure preferably comprises a float having at least one surface capable of covering the orifice which forms the outlet of the tank, which float has a density greater than that of the liquid waste and lower than that of water.

This embodiment of the closure is advantageous because it allows automatic closure of the holding tank in response to the tank being full. This is because, since the float is heavier than the oil held in the tank, the float is gradually pushed downwards towards the orifice in the bottom of the tank as the latter fills with liquid waste. When the tank is full, the float naturally presses against said orifice and thus closes off the outlet of the tank.

According to a second aspect of the invention, the retainer includes a solid waste retainer arranged on a second trajectory of said channel.

The retainer can also comprise both liquid waste retainer and a solid waste retainer. The fact that these retainers are placed on first and second trajectories makes it possible to ensure that the flow of water along one of the two trajectories is not interrupted solely because the flow of water along the other trajectory is interrupted.

If the solid waste retainer is arranged upstream of the water flow channel with respect to the liquid waste retainer, the first and second trajectories of said channel may be coincident between the inlet of the channel and an outlet of the solid waste retainer.

Such an arrangement of the liquid waste retainer and the solid waste retainer makes it possible to reduce the size of the vessel while minimizing the risks of premature interruptions in the water flow trajectories.

This is mainly because an interruption to the flow of water occurs when the liquid waste retainer is full of such waste. The interruption prevents discharge of liquid waste towards the water outlet of the vessel. The location of the solid waste retainer upstream of the liquid waste retainer, with the first and second trajectories diverging downstream of the solid waste retainer, makes it possible to ensure that an interruption to the flow of water through the liquid waste retainer does not significantly affect the operation of the solid waste retainer.

The solid waste retainer can have various configurations, and can in particular comprise at least one grille arranged across the water flow channel.

The means solid waste retainer preferably comprises a first and a second grille which project with respect to one another and are secured to one another so as to form an assembly, which assembly can move with respect to said vessel.

This preferred embodiment of the solid waste retainer allows said waste to be collected and stored in an effective manner, and makes it possible to easily empty the waste into a container when the vessel is to be unloaded of its waste.

The vessel can be set in motion in many ways, for example by an electric propeller motor or a spark ignition motor, such as an outboard motor with an adapted flow deflector. According to a third aspect of the invention, a vessel as described above also comprises a turbine designed to drive said vessel in motion, which turbine has an inlet arranged downstream of the outlet of the water flow channel and an outlet designed to produce a jet of water towards the outside of said vessel, below the surface of the body of water or waterway.

This third aspect of the invention is advantageous in that, since the turbine is placed in the continuation of the water flow channel, said turbine can control the water flow rate in said channel, and in particular can increase this flow rate, which is particularly useful for example during a start-up phase. Even though movement of the vessel is relatively slow during the start up phase, effective collection of the waste is ensured by a high flow rate brought about by the turbine in the water flow channel.

The outlet of the turbine advantageously includes a deflector which has an adjustable position, which position determines the direction of a jet of water produced by said turbine.

The deflector makes it possible to maneuver the vessel without requiring any other structure dedicated to this specific purpose, such as an attached rudder.

In the case where the vessel has a single hull, the water inlet and water outlet are preferably in the bow and in the stern of said hull, which will comprise a hollow part defining the water flow channel.

However, according to a fourth aspect of the invention, a vessel as described above has at least two hulls which are secured to one another and are substantially parallel to one another. The distance separating said hulls defines the width of the water flow channel.

Such a multi-hull structure gives the vessel greater stability and better maneuverability, and makes it possible to produce the water flow channel in a simple manner, said channel being formed naturally between the hulls.

Such a vessel could also comprise a fairing which connects the bottoms of said hulls. The distance separating said fairing from the surface of the body of water or waterway defines the depth of the water flow channel.

The fairing makes it possible to isolate the water flow channel from any eddy coming from below the vessel which could risk disturbing the operation of the retaining means.

This fairing can include rolling elements, such as wheels, to facilitate moving the vessel on dry land.

BRIEF DESCRIPTION OP THE DRAWING

The above mentioned features of the invention, and also others, will emerge more clearly from reading the following description of one example of embodiment, said description being given in relation to the appended drawings, in which.

DETAILED DESCRIPTION OF THE DRAWING

Figure 1:
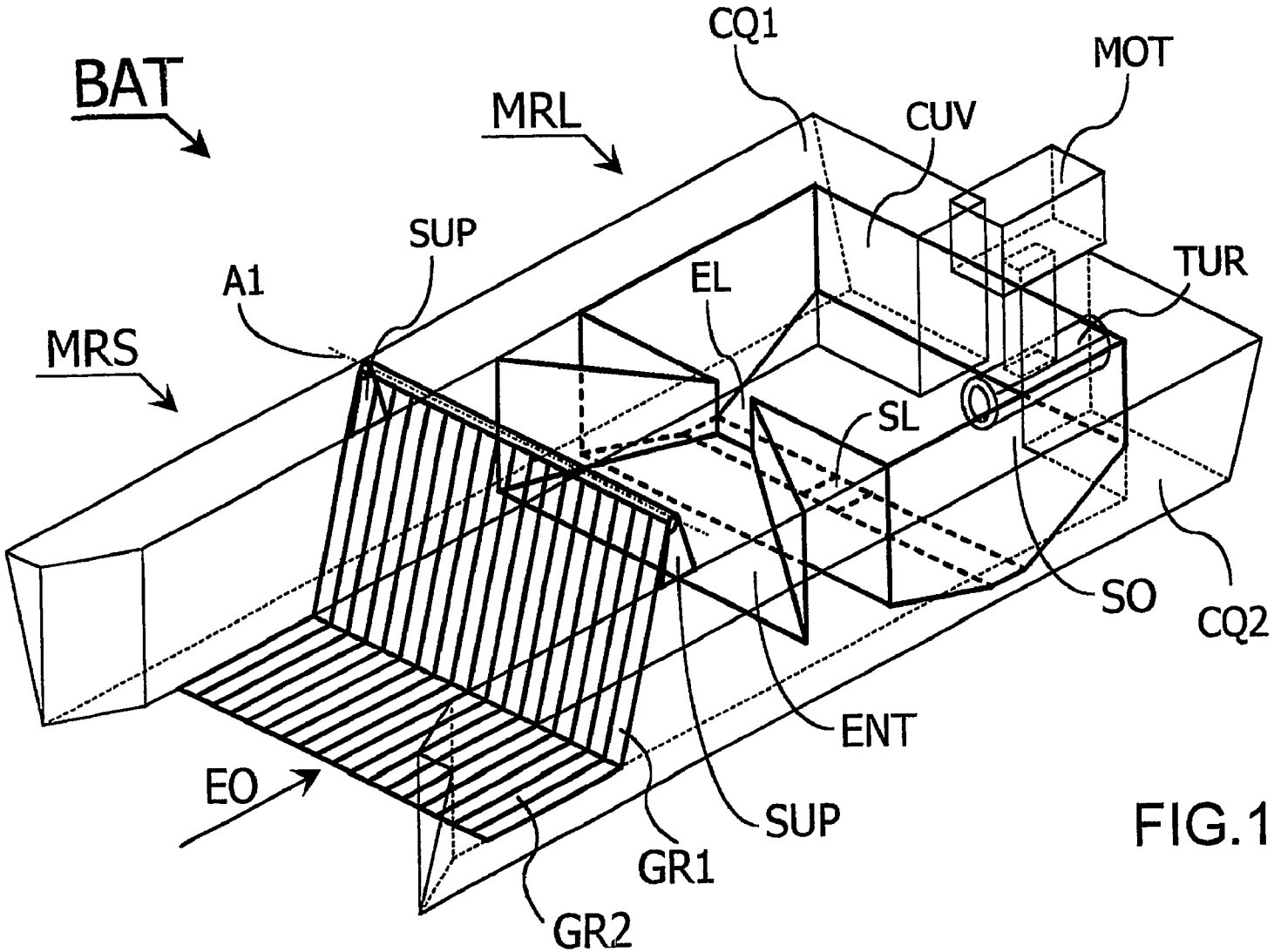
FIG. 1 is a schematic perspective representation of a vessel according to one particular embodiment of the invention.

FIG. 1 is a schematic diagram of a vessel BAT according to one particular embodiment of the invention. This vessel BAT is designed to travel over a surface of a body of water or a waterway, and to collect on board waste that is present on said surface. The vessel BAT comprises retaining means (MRS MRL) which are able to trap and retain waste and to be activated by a movement of the vessel. These retaining means (MRS MRL) are shown in bold lines in the present figure.

In this example of embodiment, the vessel BAT comprises two hulls CQ1 and CQ2 which are secured to one another and are substantially parallel to one another. These hulls define between them a water flow channel which is designed to connect a water inlet EQ and a water outlet SO when the vessel BAT is moving, the retaining means (MRS MRL) being arranged on at least one trajectory of said channel.

The retaining means (MRS, MRL) comprise means of retaining liquid waste MRL which are arranged on a first trajectory of said channel. These means of retaining liquid waste MRL comprise a holding tank CTJV which is designed to be passed through by the water flow channel when the vessel BAT is moving.

The vessel BAT in this case comprises means HM for heating an upper surface of the water flow channel, said means being designed to fluidify liquid waste formed by oil which could be present in the form of clumps or semi-liquid pellets. These heating means HM could for example emit electromagnetic radiation EMW in the form of infrared waves or microwaves, the amplitude and wavelength of which would have to be regulated beforehand in order to ensure that said radiation EMW penetrates to a predetermined depth De, which may for example be between 5 and 15 centimetres.

The vessel BAT will also advantageously comprise means of regulating the temperature inside the holding tank CUV, which means have not been shown here in order not to unnecessarily clutter up the present figure, which regulating means will make it possible to keep the oil contained in the tank CtJV in a liquid state, with a view to facilitating subsequent emptying of the tank, for example by pumping. These regulating means could for example consist of electrical resistors integrated in the walls of the tank CtJV and designed to be supplied with an electrical current when the temperature inside the tank CtJV falls below a predetermined threshold value.

In the embodiment described here, the holding tank CtJV has:

an inlet EL, designed to be connected to the inlet EQ of the water flow channel, formed by an upper edge of said tank and designed to be placed close to the surface of the water, and an outlet SL, designed to be connected to the outlet SO of said channel, formed by an orifice made in a bottom of the holding tank CTJV and designed to be obstructed by closure means (not shown here) when said tank CtJV is full of liquid waste.

The means of retaining liquid waste MRL in this case also comprise a funnel ENT which is designed to direct a flow of water towards the holding tank C and to thus promote the creation of the first trajectory of the water flow channel.

The retaining means (MRS, MRL) also comprise means of retaining solid waste MRS which are arranged upstream of the water flow channel with respect to the means of retaining liquid waste MRL. These means of retaining solid waste MRS comprise a first and a second grille GR1 and GR2 which are arranged across the water flow channel, project with respect to one another and are secured to one another so as to form an assembly (GR1, GR2), which assembly can move with respect to said vessel by means of a pivot linic with two supports SUP secured to the first and second hulls CQ1 and CQ2, which pivot link allows rotation of said assembl.y (GR1, GR2) about an axis of rotation A1.

The vessel BAT also comprises a turbine TUR which is controlled by a motor MOT and is designed to drive said vessel in motion, which turbine has an inlet arranged downstream of the outlet SO of the water flow channel and an outlet designed to produce a jet of water towards the outside of said vessel BAT, below the surface of the body of water or waterway.

Figure 2:
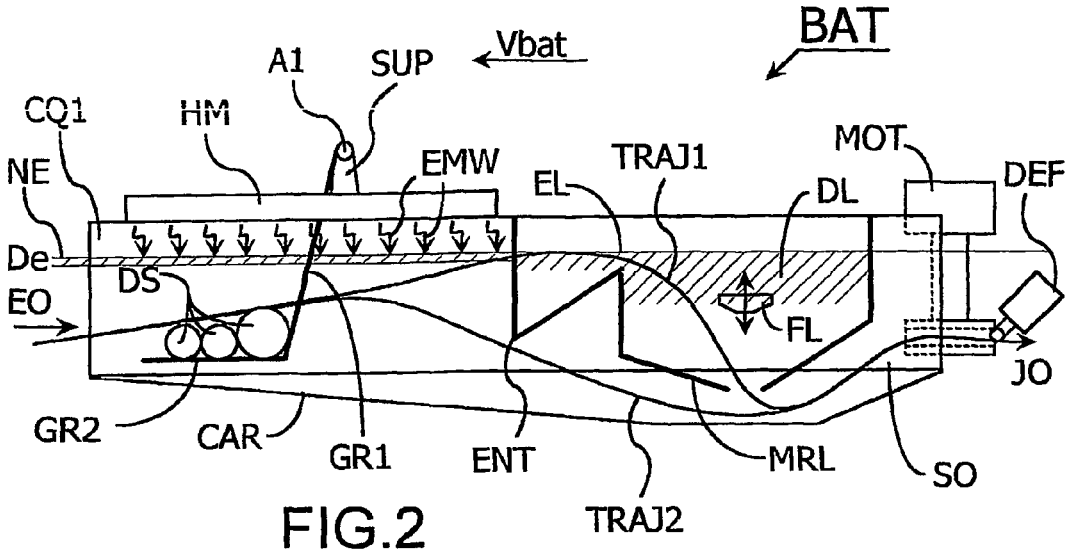
FIG. 2 is a schematic representation of such a vessel, seen from its port side, in a first operation configuration.

FIG. 2 is a schematic diagram of this vessel BAT, seen from its port side, in a first operation configuration. The elements of this vessel which have already been described above bear the same references and will not be described again. This schematic view nevertheless makes it possible to see a deflector DEF which is provided on the outlet of the turbine controlled by the motor MaT, which deflector DEF has an adjustable position which determines a direction of the jet of water JO produced by said turbine. This schematic view also shows a fairing CAR which connects the bottoms of the two hulls of the vessel BAT.

The vessel BAT is in this case travelling over the surface of a body of water, the level of which is shown by a line NE. In this first configuration, the deflector DEF is in a high position, so that the jet of water JO produced by the turbine is directed towards the rear of the vessel BAT, which then moves forwards at a speed Vbat. The relative speed of the vessel with respect to the body of water gives rise to a water flow channel which connects the water inlet EO and the water outlet SO. The establishment of this water flow channel is also promoted by the flow of water through the turbine, the flow rate of water in this channel thus being able to be controlled by controlling the motor MOT.

The means of retaining liquid waste MRL are arranged on a first trajectory TRAJ1 of the water flow channel, with the means of retaining solid waste formed by the first and second grilles GR1 and GR2 being arranged on a second trajectory TRAJ2 of said channel.

Since the first and second grilles GR1 and GR2 which form the means of retaining solid waste are arranged upstream of the water flow channel with respect to the means of retaining liquid waste MRL, the first and second trajectories TPAJ1 and TRAJ2 are coincident between the inlet EQ of the water flow channel and an outlet of the means of retaining solid waste, which in this case is located between the first grille GR1 and the funnel ENT of the means of retaining liquid waste MRL.

An adjustable sill (not shown here) can be located upstream of the first and second grilles GR1 and GR2 so as to control the coincident flows of the first and second trajectories TRAJ1 and TRAJ2 as a function of a draught of the vessel BAT, which draught could for example be caused by overloading of said vessel.

All solid waste DS having a size greater than a spacing between two adjacent bars of the first and second grilles GR1 and GR2 is retained by said grilles as the vessel moves along. However, the first and second grilles GR1 and GR2 do not form an obstacle to the passage of liquid elements, and thus remove only solid waste DS from the water taken in via the water inlet EO. The water present at the outlet of the means of retaining solid waste may contain liquid waste DL close to the surface, said liquid waste being shown here by hatching close to the water level NE, such as oil slicks as is often the case in port waters. This liquid waste DL is directed along the first trajectory TRAJ1 by the funnel ENT towards the inlet EL of the holding tank, where it will accumulate at the surface since the density thereof is lower than that of water, which water can escape through the outlet orifice of the tank towards the outlet SO of the water flow channel. The creation of the flow along the first trajectory TRAJ1 is also promoted in this embodiment by a Venturi effect generated by the particular shape of the holding tank, which in this case has a surface area that decreases in the depth direction.

The second trajectory TRAJ2 of the water flow channel also makes it possible for water which contains no liquid waste, since it has been taken from a greater depth, to flow between the fairing CAR and the bottom of the holding tank towards the water outlet SO. This second trajectory TRAJ2 is not significantly disturbed if the first trajectory TRAJ1 is interrupted.

The means of retaining liquid waste MRL comprise closure means which are designed to obstruct the holding tank when the latter is full of liquid waste DL. These closure means in this case consist of a float FL which consists of material having a density greater than that of the liquid waste DL and lower than that of water, so that the float is naturally held in position just below a line of separation between the liquid waste DL and the water which are contained together in the holding tank. This makes it possible to automatically close the holding tank when said tank is full. This is because the float FL is gradually pushed towards the orifice in the bottom of the tank as the latter fills up with liquid waste DL. When the tank is full, the float is naturally pressed against said orifice and therefore closes off the outlet of the tank.

Figure 3:
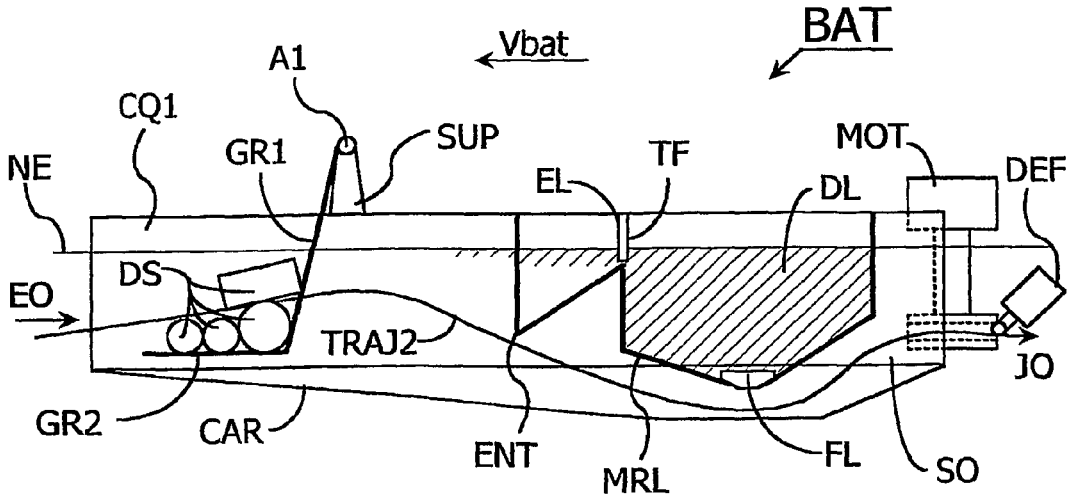
FIG. 3 is a schematic representation of such a vessel, seen from its port side, in a second operation configuration.

FIG. 3 is a diagram of such a condition in the torm of a second configuration, in which the first trajectory TRAJ1 is interrupted on account of the float FL closing off the orifice made in the bottom of the tank of the means MRL of retaining liquid waste DL. In order to prevent said tank from overflowing in the presence of eddy which could cause the water level NE to vary rapidly, a closure flap TF has also been actuated so as to obstruct the inlet EL of the holding tank. The second trajectory TRAJ2 has not been significantly affected by the interruption to the first trajectory TRAJ1, so that water continues to flow into the flow channel connecting the water inlet EQ and the water outlet SO, with the vessel BAT continuing to move at the speed Vbat. The continuing existence of this channel, which is obtained by virtue of the second trajectory TRAJ2, makes it possible for the means of retaining solid waste to continue to operate, as shown by the presence of new solid waste DS collected by the first and second grilles GR1 and GR2.

Figure 4:
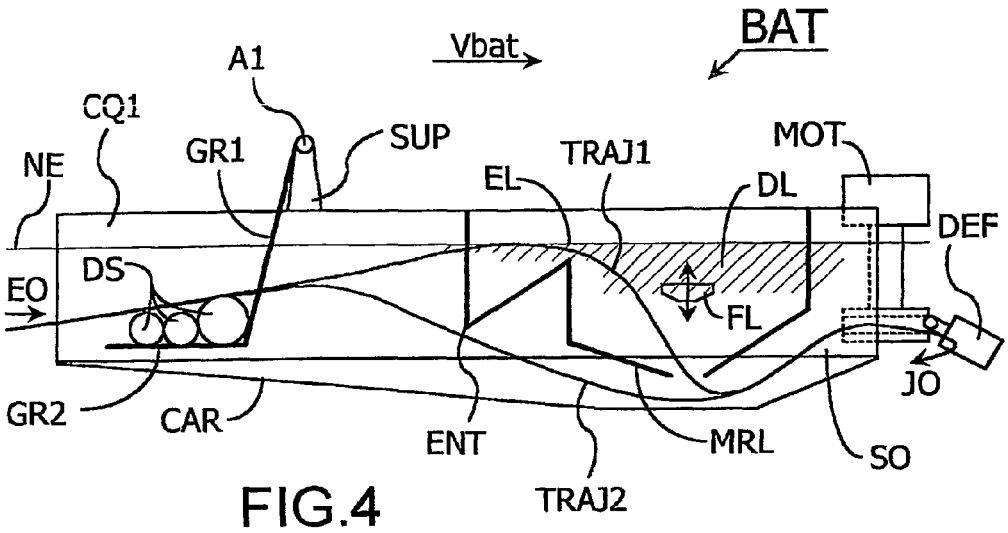
FIG. 4 is a schematic representation of such a vessel, seen from its port side, in a third operation configuration.

FIG. 4 is a diagram of a third possible operation configuration of a vessel BAT according to the particular embodiment described above. In this third configuration, the deflector DEF provided on the outlet of the turbine controlled by the motor MOT is in the low position, so that it interferes with a jet of water JO produced by said turbine by deflecting it towards the front of the vessel BAT. This has the effect of reversing the direction of the speed Vbat of said vessel BAT, and thus of moving said vessel backwards. Such an ability to move backwards is particularly useful in situations where the vessel BAT has only a small space to maneuver, for example in port installations where the available space is usually occupied as far as possible by ships at the quayside or in the course of docking or departing. The deflector DEF could also consist of an assembly of a port semi-deflector and a starboard semi-deflector, the latter not being shown in the present figure in which only the port semi-deflector can be seen, it then being possible for said semi-deflectors to be controlled separately so as to inflect the direction of the jet of water JO produced by the turbine towards port or starboard.

It should be noted that, even if the direction of movement of the vessel BAT is reversed, as is the case in this third configuration, the flow of water generated by the turbine makes it possible to maintain a sufficient flow rate between the water inlet EO and the water outlet SO in order to keep the means (GR1, GR2) of retaining solid waste DS and the means MRL of retaining liquid waste DL active, with neither of the first and second trajectories TRAJ1 and TRAJ2 then being interrupted, at least until the holding tank for the liquid waste DL is full as mentioned above.

In one very particular configuration, it may even happen that the deflector DEF is oriented so that the jet of water Jo produced by the turbine has a vertical direction. The speed Vibat of the vessel BAT with respect to the body of water or waterway will then be zero, once any effect of inertia has dissipated, but the flow rate between the water inlet EQ and the water outlet SO will be maintained and will keep the means (GR1, GR2) of retaining solid waste DS and the means P of retaining liquid waste DL active, even though the movement of the vessel BAT has been interrupted.

Figure 5:
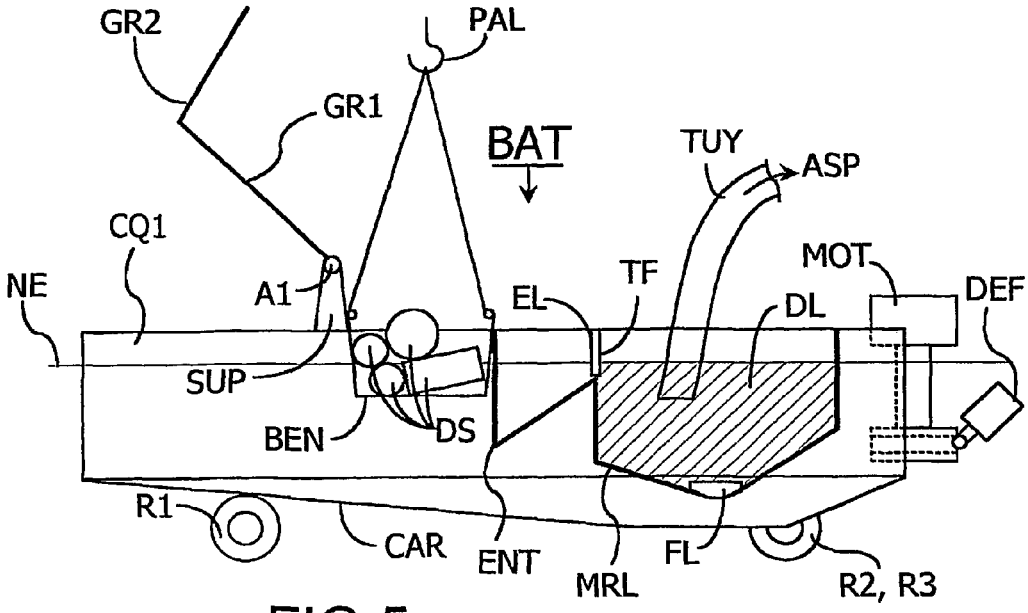
FIG. 5 is a schematic representation of such a vessel, seen from its port side, in a fourth operation configuration.

FIG. 5 is a diagram of a fourth possible operation configuration of a vessel BAT according to the particular embodiment described above. In this fourth configuration, the vessel BAT has been docked with a view to unloading the various waste that it has collected on board. For this purpose, the assembly formed by the first and second grilles GR1 and GR2 has been rotated about the axis A1 of the pivot link which connects said assembly (GR1, GR2) to the supports SUP, which pivot link in this example gives said assembly (GR1, GR2) its mobility with respect to the vessel BAT. In other embodiments, the assembly formed by the first and second grilles GR1 and GR2 could be removed completely. The solid waste DS collected and stored by the means of retaining solid waste formed by said first and second grilles GR1 and GR2 is then poured into a skip BEN which in this example is suspended on a mobile hoist PAL. The liquid waste DL contained in the holding tank, the inlet and outlet of which were closed beforehand by the closure flap TF and the float FL respectively, is then removed using an emptying pipe TtJY by creating a suction force ASP.

It will be noted that such operations of unloading the vessel BAT can also be carried out on dry land, the lower surface of the fairing CAR of the vessel BAT being provided with rolling elements, in this example a front wheel Ri and two rear wheels R2 and R3, only the port wheel of which can be seen, in order to facilitate operations of moving the vessel BAT on dry land. These rolling elements R1, R2 and R3 are also very useful for loading said vessel BAT onto a platform or a trailer in order to transport it, for example over land, and for setting the vessel BAT afloat, since all that will be required then is to roll it along the shore, which omits the need to use a crane.

The invention claimed is:

1. Vessel for collecting on board the vessel waste that is close to and/or on a surface of a body of water or a waterway, said vessel comprising a floating liquid waste holding tank, a water flow channel arranged in said vessel between a water inlet and a water outlet of the vessel, and a turbine for creating a water flow in the water flow channel, the water flow channel being downstream from said inlet and upstream from an inlet of the tank such that liquid including liquid waste can flow from the inlet into the tank, the holding tank including: (a) an inlet adapted to be connected to the inlet of the water flow channel, the holding tank inlet being formed by an upper edge of said tank and adapted to be located close to the surface of the water, and (b) an outlet adapted to be connected to the outlet of said channel, the holding tank outlet being formed by an orifice in a bottom of said tank and adapted to be obstructed by a closure in response to said tank being full of liquid waste;

the closure comprising a float having at least one surface for covering the orifice which forms the outlet of the tank, the float having a density greater than that of the liquid waste and lower than that of the water.

2. A vessel for collecting on board the vessel waste that is close to and/or on a surface of a body of water or a water way, said vessel having at least one hull and comprising:

a floating liquid waste holding tank including an inlet close to the surface of the water, a water flow channel arranged in said vessel between a water inlet of the vessel and a water outlet of the channel, the water flow channel being isolated from the outside of the vessel by a fairing and comprising two trajectories for liquid, and a turbine for (a) creating a water flow in the water flow channel and (b) causing liquid flowing through the channel outlet to flow through the turbine, thence outboard of the vessel, between the water inlet of the channel and the tank, the water flow channel and the turbine being arranged for causing (a) liquid with liquid waste and liquid without liquid waste to flow together in a first part of the channel, (b) the liquid with liquid waste and liquid without liquid waste to be separated downstream of the first part of the channel into first and second trajectories, respectively, (c) the liquid in the first trajectory to flow into the tank, (d) the liquid emerging from the tank, without liquid waste and in the first trajectory, to flow through the turbine, and (e) the liquid in the second trajectory to flow downstream of the first part of the channel to by-pass the tank and to flow through the turbine, and (e) the liquid without liquid waste to flow downstream of the first part of the channel into the second trajectory, between the fairing and the bottom of the tank, and to flow through the turbine, the tank being formed to cause liquid in the first trajectory in the tank to flow with a Venturi effect for causing the liquid without liquid waste emerging from the tank to flow through the turbine with a Venturi effect.

3. Vessel according to claim 2 further comprising a heater of an upper surface of the water flow channel.

4. Vessel according to claim 2, further comprising a regulator for the temperature inside the holding tank.

5. Vessel according to claim 2, wherein the holding tank includes:

an inlet adapted to be connected to the inlet of the water flow channel, the holding tank inlet being formed by an upper edge of said tank and adapted to be located close to the surface of the water, and an outlet adapted to be connected to the outlet of said channel, the holding tank outlet being formed by an orifice in a bottom of said tank and adapted to be obstructed by a closure in response to said tank being full of liquid waste.

6. Vessel according to claim 5, wherein the closure comprises a float having at least one surface for covering the orifice which forms the outlet of the tank, the float having a density greater than that of the liquid waste and lower than that of the water.

7. Vessel according to claim 5, wherein the holding tank inlet and outlet are respectively connected to the water flow channel inlet and outlet.

8. Vessel according to claim 2, wherein the vessel also includes a solid waste retainer located upstream of the water flow channel, with respect to the liquid waste holding tank, and in the first and second trajectories of said channel.

9. Vessel according to claim 8, wherein the first and second trajectories of said channel are coincident between the inlet of the water flow channel and an outlet of the solid waste retainer.

10. Vessel according to claim 2, wherein the solid waste retainer comprises a first and second grille which project with respect to one another and are secured to one another to form an assembly that can move with respect to said vessel.

11. Vessel according to claim 2, wherein the turbine is also arranged for driving said vessel in motion, and has (a) an inlet downstream of the outlet of the water flow channel and (b) an outlet for producing a water jet towards the outside of said vessel, below the surface of the body of water or waterway.

12. Vessel according to claim 2, wherein the vessel includes at least two hulls which are secured to one another and are substantially parallel to one another, said hulls being separated by a distance defining the water flow channel width and a fairing that connects the bottom of said hulls, said fairing being positioned on the vessel from the surface of the body of water or waterway by a distance defining the water flow channel depth.

13. Vessel according to claim 12, further including rolling elements on a lower surface of the fairing, the rolling elements being positioned and arranged so they roll and bear the load of the vessel during movement of the vessel on dry land.

14. The vessel of claim 2 wherein the tank is formed to have a decreasing surface area as the depth of the tank increases for providing the Venturi effect.

15. The vessel of claim 2 further including a solid waste retainer located between the vessel inlet and the first part of the channel, the solid waste retainer being arranged for causing liquid including liquid waste and solid waste to flow from the water inlet of the vessel into the solid waste retainer and liquid in the first and second trajectories to flow from the solid waste retainer, the first part of the channel being downstream of the solid waste retainer.

16. Apparatus adapted to be located on a vessel for collecting on board the vessel waste that is close to and/or on a surface of a body of water or a water way, said apparatus comprising:

a floating liquid waste holding tank, a water flow channel arranged in said vessel between a water inlet of said vessel, the water flow channel being isolated from the outside of the vessel a turbine for creating a water flow along two trajectories in the water flow channel and causing liquid flowing through the channel outlet to flow through the turbine, thence outboard of the vessel, the water flow channel and the turbine being arranged for causing:

(a) liquid with liquid waste and liquid without liquid waste to flow together in a first part of the channel, where the first and second trajectories are coincident, the first part of the channel being uprstream of the holding tank, (b) the liquid with liquid waste and liquid without liquid waste to be separated downstream of the first part of the channel into first and second trajectories, respectively, (c) the liquid in the first trajectory to flow into the tank, (d) the liquid in the second trajectory to flow downstream of the first part of the channel to by-pass the tank and to flow through the turbine, (e) the liquid in the first trajectory, without liquid waste, emerging from the tank to flow through the turbine with a Venturi effect.

17. The apparatus of claim 16 further including a solid waste retainer adapted to be located between the vessel inlet and the first part of the channel, the solid waste retainer being arranged for causing liquid including liquid waste and solid waste to flow from the inlet into the solid waste retainer and liquid in the first and second trajectories to flow from the solid waste retainer, the first part of the channel being downstream of the solid waste retainer.

* * * * *